US006591553B1

(12) United States Patent
Vaughn

(10) Patent No.: US 6,591,553 B1
(45) Date of Patent: Jul. 15, 2003

(54) ENTRANCEWAY BARRIER APPARATUS

(76) Inventor: Andre B. Vaughn, 14461 SW. 139 Ave. E., Miami, FL (US) 33186

( * ) Notice: Subject to any disclaimer, the term of this patent is extended or adjusted under 35 U.S.C. 154(b) by 8 days.

(21) Appl. No.: 10/122,929

(22) Filed: Apr. 12, 2002

(51) Int. Cl.[7] ..... E06B 7/18
(52) U.S. Cl. ..... 49/466; 52/202
(58) Field of Search ..... 49/463, 466, 55, 49/61; 52/2 B, 169.14, 202, 204, 63

(56) References Cited

U.S. PATENT DOCUMENTS

| | | | | |
|---|---|---|---|---|
| 3,861,081 A | | 1/1975 | Maskell | |
| 4,375,929 A | | 3/1983 | Clark | |
| 4,682,443 A | * | 7/1987 | Demo | 49/466 |
| 4,685,261 A | | 8/1987 | Seaquist | |
| 4,787,174 A | * | 11/1988 | Brown | 49/55 |
| 4,934,868 A | * | 6/1990 | Hellstrom et al. | 405/105 |
| 5,077,945 A | | 1/1992 | Koeniger | |
| 5,460,462 A | * | 10/1995 | Regan | 405/96 |
| 5,470,177 A | | 11/1995 | Hughes | |
| D398,404 S | | 9/1998 | Hope | |
| 5,943,832 A | * | 8/1999 | Russell | 52/202 |
| 6,427,396 B1 | * | 8/2002 | Harrison | 52/202 |

FOREIGN PATENT DOCUMENTS

| | | | |
|---|---|---|---|
| GB | 2318145 | * | 4/1998 |
| GB | 2356661 | * | 5/2001 |

* cited by examiner

*Primary Examiner*—Jerry Redman

(57) ABSTRACT

An entranceway barrier apparatus for blocking floodwaters from entering an entranceway. The entranceway barrier apparatus includes a frame assembly for selectively mounting in a lower portion of the doorway. The frame assembly has a main channel extending therein. The frame assembly includes a pair of L-shaped sections that are telescopically couplable. A plurality of locking members selectively locks each of the sections of the frame assembly together in a desired position when the sections are telescopically coupled. A main channel gasket is positioned in the main channel of the frame assembly. A severable panel member is positionable in the main channel of the frame assembly adjacent to the channel gasket to seal between the panel member and the frame assembly. A frame gasket seals between the frame assembly and the doorway.

10 Claims, 5 Drawing Sheets

ENTRANCEWAY BARRIER APPARATUS

BACKGROUND OF THE INVENTION

1. Field of the Invention

The present invention relates to entranceway barriers and more particularly pertains to a new entranceway barrier apparatus for blocking floodwaters from entering an entranceway.

2. Description of the Prior Art

The use of entranceway barriers is known in the prior art. U.S. Pat. No. 5,077,945 describes a doorway flood barrier. Another type of entranceway barrier is U.S. Pat. No. 3,861,081 having a U-shaped channel structure, with the legs secured either to the walls of the home immediately adjacent to a door frame or to inner faces of the door opening, with the back of the U extending across the door sill.

While these devices fulfill their respective, particular objectives and requirements, the need remains for a device is more flexible.

SUMMARY OF THE INVENTION

The present invention meets the needs presented above by providing a means to adjust the width of the barrier to the width of the particular opening for which it is to be utilized in.

An object of the present invention is to provide a new entranceway barrier apparatus that by the nature of its design does not require any fasteners to be attached directly to the structure it is being installed in.

Another object of the present invention is to provide a new entranceway barrier apparatus that is easier and faster to install.

To this end, the present invention generally comprises a frame assembly for selectively mounting in a lower portion of the doorway. The frame assembly has a main channel extending therein. The frame assembly includes a pair of L-shaped sections that are telescopically couplable. A plurality of locking members selectively locks each of the sections of the frame assembly together in a desired position when the sections are telescopically coupled. A main channel gasket is positioned in the main channel of the frame assembly. A severable panel member is positionable in the main channel of the frame assembly adjacent to the channel gasket to seal between the panel member and the frame assembly. A frame gasket seals between the frame assembly and the doorway.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
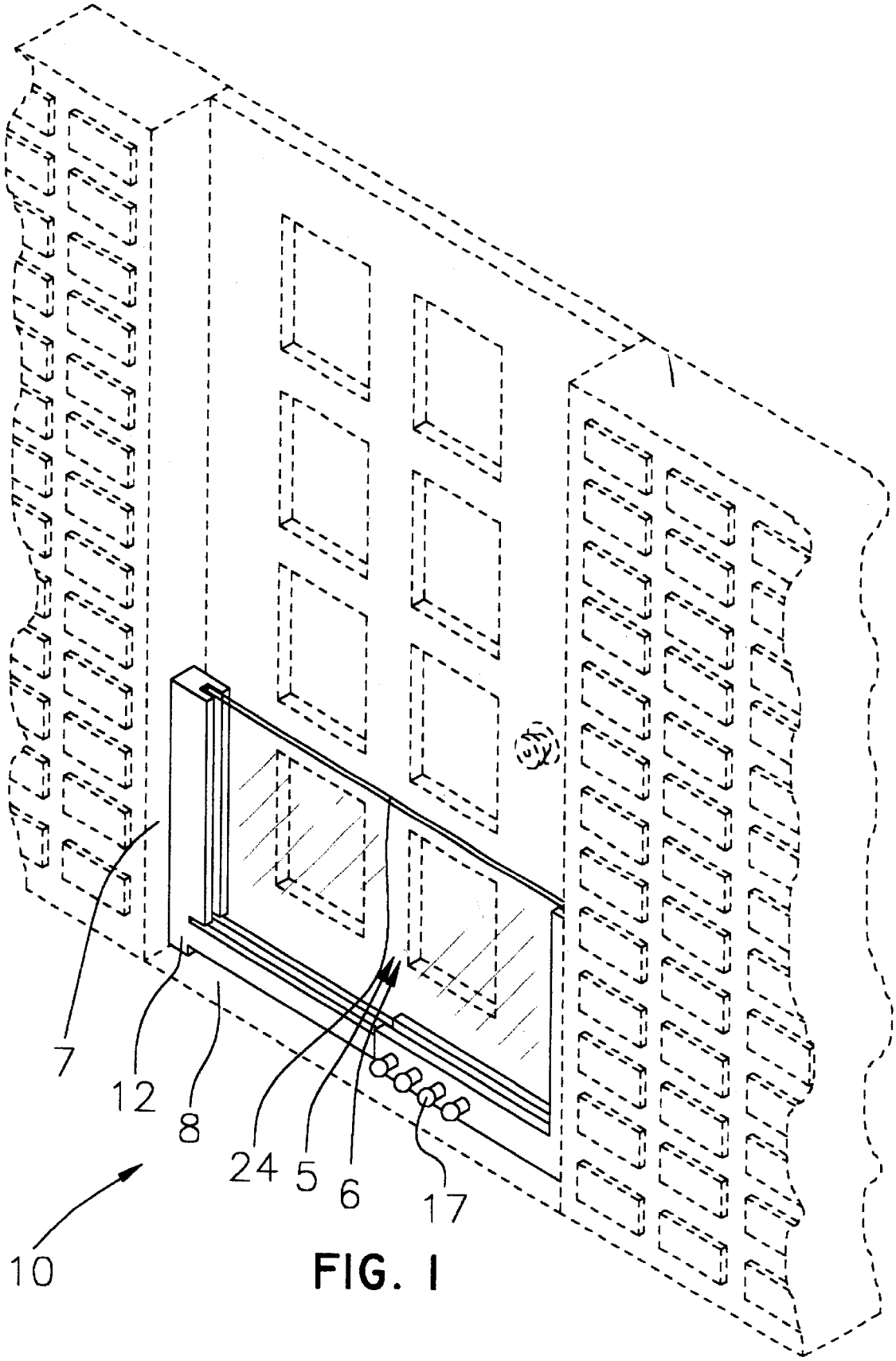
FIG. 1 is a schematic perspective view of a new entranceway barrier apparatus installed in a doorway according to the present invention.
Figure 2:
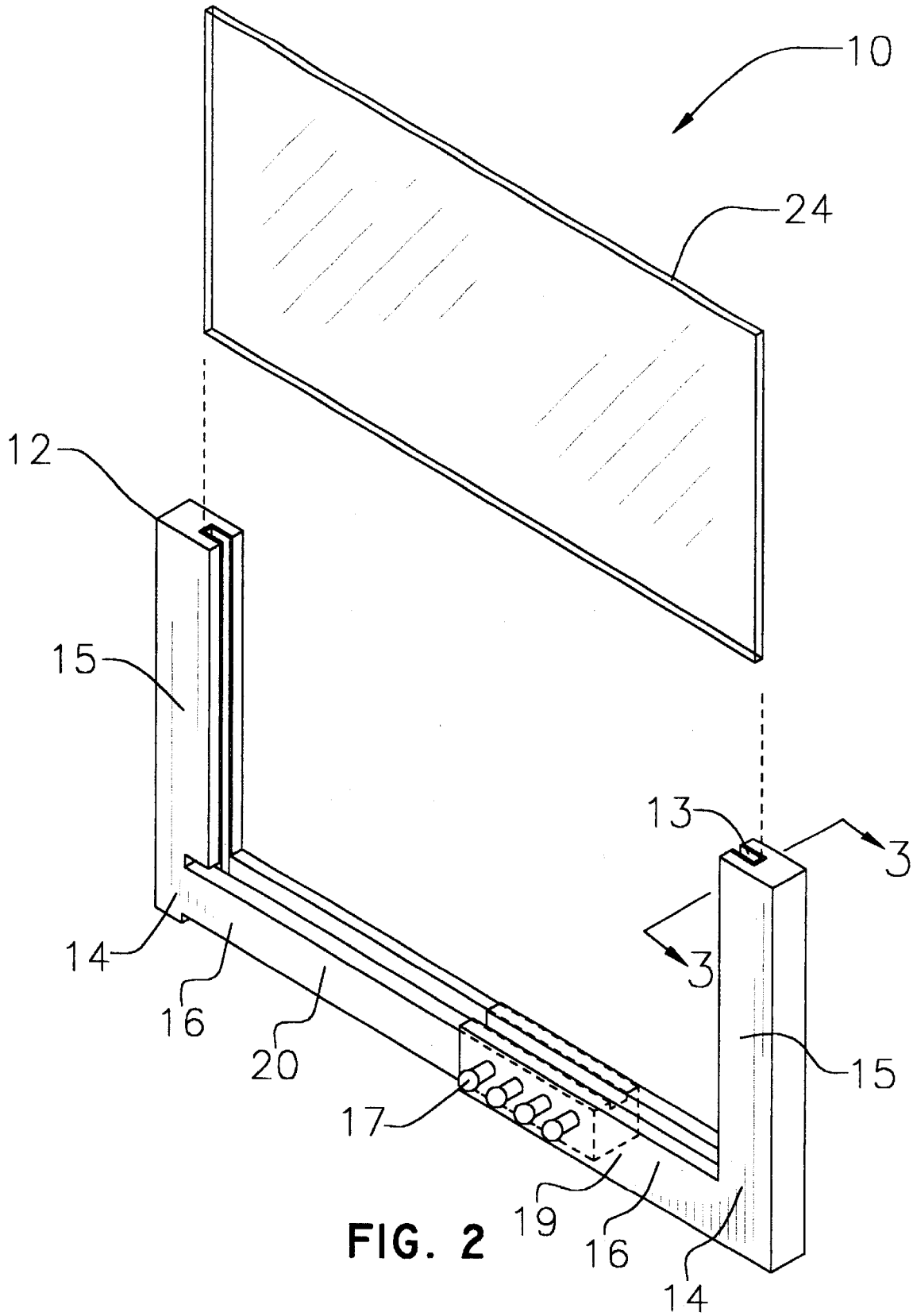
FIG. 2 is a schematic perspective view of the present invention with the panel member out of the main channel.
Figure 3:
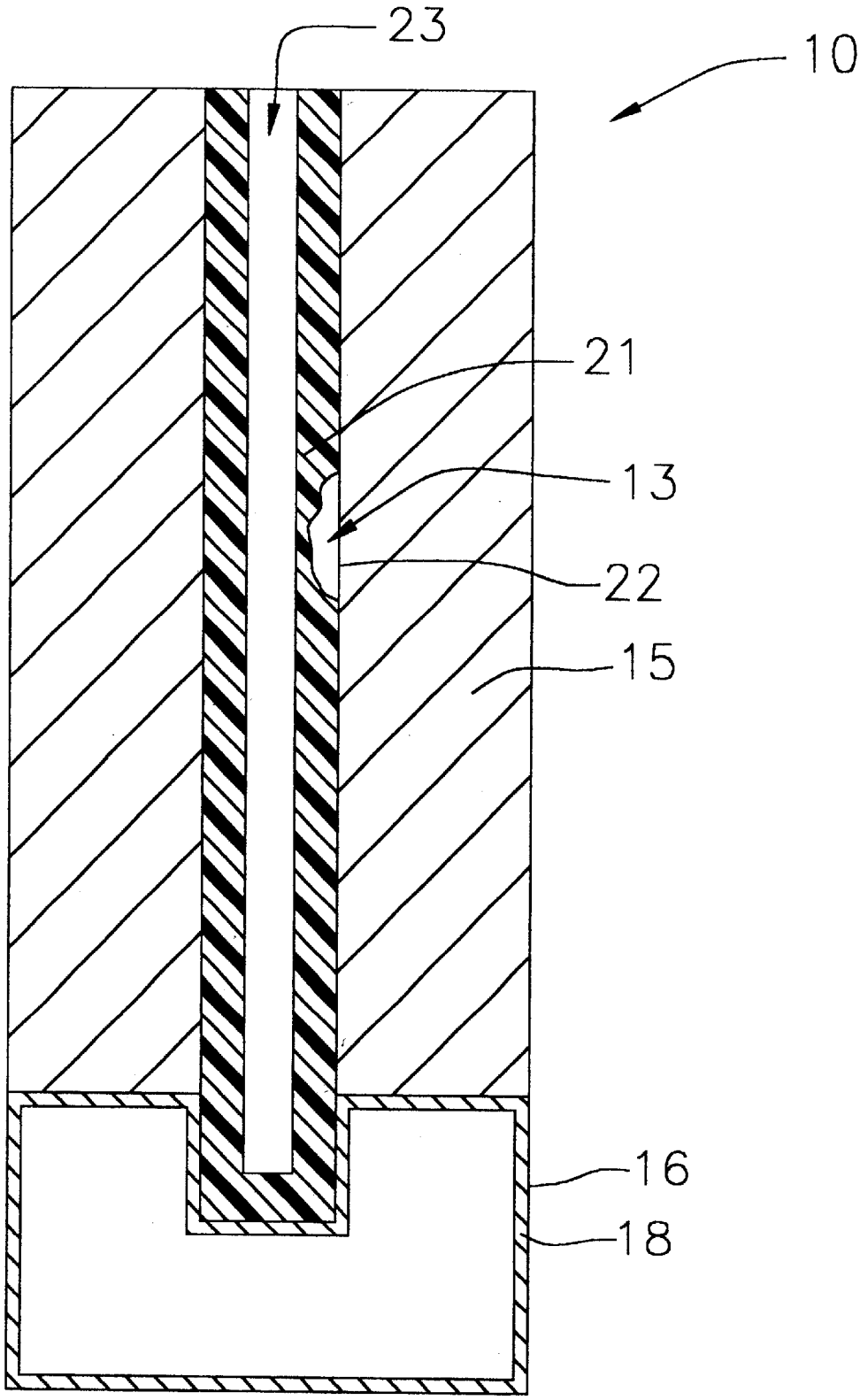
FIG. 3 is a schematic cross-sectional end view of the present invention taken along sectional lines 3—3 in FIG. 2.
Figure 4:
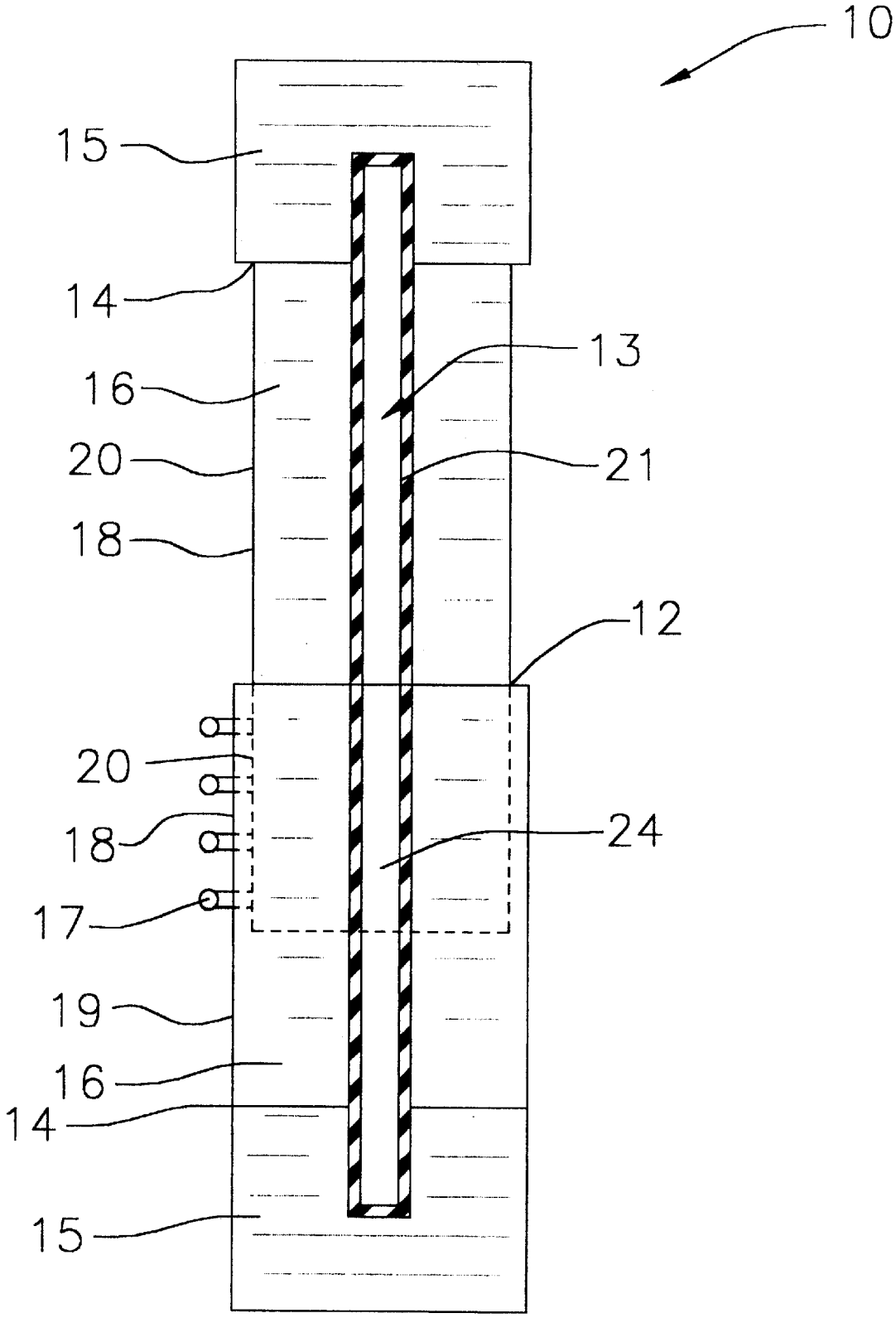
FIG. 4 is a schematic top view of the present invention.
Figure 5:
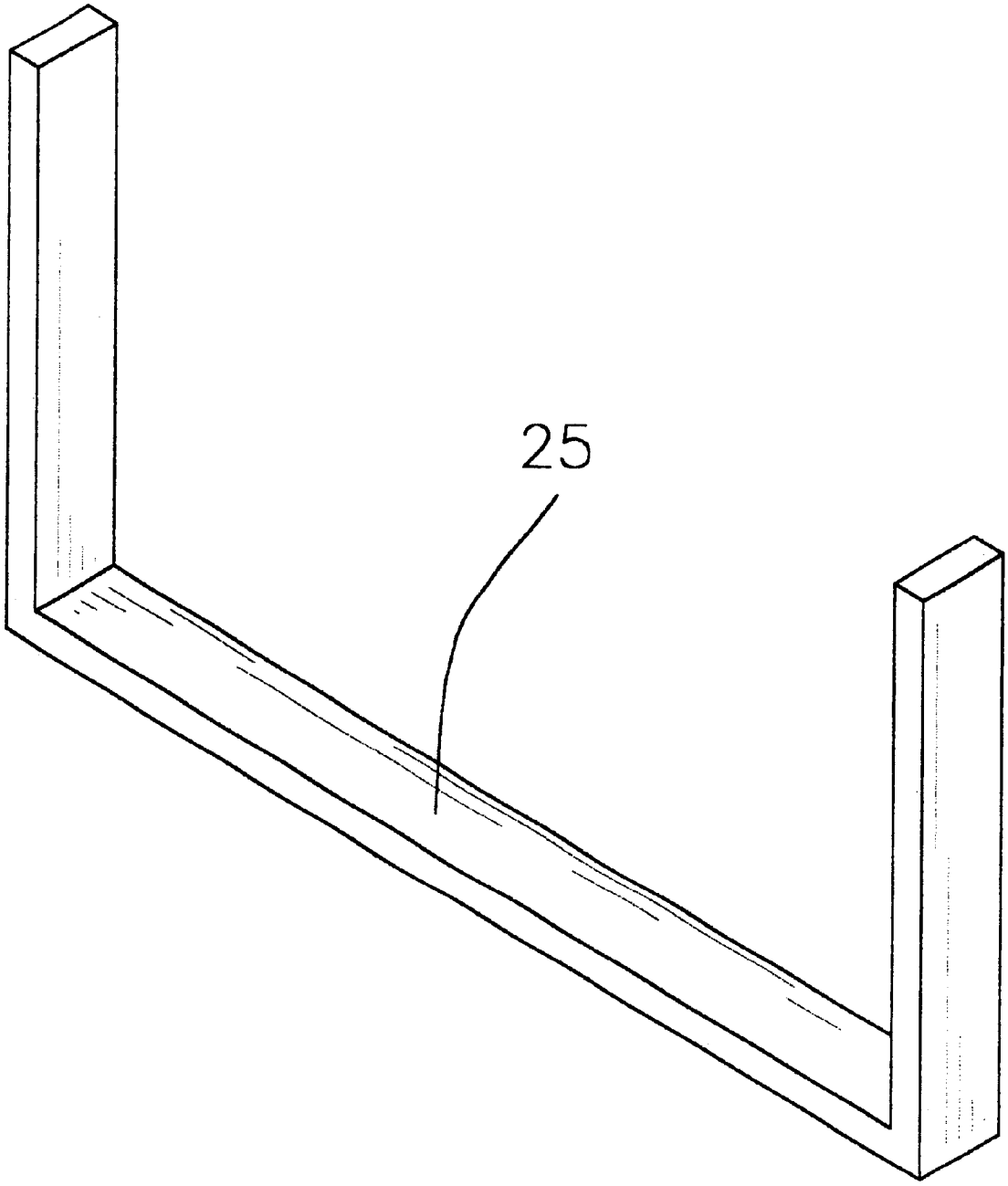
FIG. 5 is a schematic perspective view of the frame gasket of the present invention.

With reference now to the drawings, and in particular to FIGS. 1 through 5 thereof, a new entranceway barrier apparatus embodying the principles and concepts of the present invention and generally designated by the reference numeral 10 will be described.

As best illustrated in FIGS. 1 through 5, the entranceway barrier apparatus 10 generally comprises a frame assembly 12 for selectively mounting in a lower portion 6 of a doorway 5. The frame assembly 12 has a main channel 13 extending therein, and includes a pair of L-shaped sections 14. Each of the sections 14 comprises an elongate vertical portion 15 for positioning adjacent to a vertical part 7 of the doorway 5, and an elongate horizontal portion 16 for positioning adjacent to a sill 8 of the doorway 5.

The horizontals portion 16 of the sections 14 are telescopic and mountable to each other such that a width of the frame assembly 12 between the vertical portions 15 is variable to fit a width of the doorway 5.

Each of the portions has a substantially C-shaped cross-section taken perpendicular to a longitudinal axis of each of the portions to form the main channel 13. Each of the sections 14 are positionable in the lower portion 6 of the doorway 5 in such a manner so that each of the horizontal portions 16 extend inward from bottom outside corners of the doorway 5 and each of the vertical portions 15 extend upward along the vertical part 7 of the doorway 5.

A plurality of locking members 17 selectively locks each of the sections 14 of the frame assembly 12 together in a desired position when the sections 14 are telescopically coupled. Each of the locking members 17 is threadably mounted through an outer wall 18 of the horizontal portion 16 of a first of the sections 19 to an outer wall 18 of the horizontal portion 16 of a second of the sections 20. Each of the locking members 17 abuts the outer wall 18 of the second section such that relative movement between each of the sections 14 is restricted.

A channel gasket 21 is positioned in the main channel 13 of the frame assembly 12. The channel gasket 21 is attached to inner walls 22 of the frame assembly 12 that define the main channel 13. The channel gasket 21 has a substantially C-shaped cross section defining a gasket channel 23.

A panel member 24 is positionable in the main channel 13 of the frame assembly 12. The panel member 24 comprises a severable material for permitting a user to cut the panel member 24 to fit in the main channel 13 of the frame assembly 12 once the frame assembly 12 is installed in the doorway 5. A thickness of the panel member 24 is generally equal to a width of the gasket channel 23 such that a seal is formed at a juncture of the panel member 24 and the channel gasket 21.

A frame gasket 25 seals between the frame assembly 12 and the doorway 5. The frame gasket 25 is selectively couplable to outer edges of the frame assembly 12 such that a seal is formed at a juncture of the frame assembly 12 and the doorway 5.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An entranceway barrier apparatus for blocking floodwaters from entering a structure through a doorway, said apparatus comprising:

a frame assembly for selectively mounting in a lower portion of the doorway, said frame assembly having a main channel extending therein, said frame assembly including a pair of L-shaped sections, each of said sections comprising an elongate vertical portion for positioning adjacent to a vertical part of the doorway and an elongate horizontal portion for positioning adjacent to a sill of the doorway;

a plurality of locking members for selectively locking each of said sections of said frame assembly together in a desired position when said sections are telescopically coupled, each of said locking members being threadably mounted through an outer wall of said horizontal portion of a first of said sections to an outer wall of said horizontal portion of a second of said sections;

a channel gasket for positioning in said main channel of said frame assembly;

a panel member for positioning in said main channel of said frame assembly; and a frame gasket for sealing between said frame assembly and the doorway.

2. The entranceway barrier apparatus as set forth in claim 1, further comprising said horizontal portions of said sections being telescopic and mountable to each other such that a width of said frame assembly between said vertical portions is variable to fit a width of the doorway.

3. The entranceway barrier apparatus as set forth in claim 1, further comprising each of said portions having a substantially C-shaped cross-section taken perpendicular to a longitudinal axis of each of said portions to form said main channel.

4. The entranceway barrier apparatus as set forth in claim 1, further comprising each of said sections being positionable in the lower portion of the doorway in such a manner so that each of said horizontal portions extend inward from bottom outside corners of the doorway and each of said vertical portions extend upward along the vertical part of the doorway.

5. The entranceway barrier apparatus as set forth in claim 1, wherein each of s aid locking members a buts said outer wall of said second section such that relative movement between each of said sections is restricted.

6. The entranceway barrier apparatus as set forth in claim 1, further comprising said channel gasket being attached to inner walls of said frame assembly to define said main channel, said channel gasket having a substantially C-shaped cross section defining a gasket channel.

7. The entranceway barrier apparatus as set forth in claim 6, further comprising a thickness of said panel member being generally equal to a width of said gasket channel such that a seal is formed at a juncture of said panel member and said channel gasket.

8. The entranceway barrier apparatus as set forth in claim 1, further comprising said panel member comprising a severable material for permitting a user to cut said panel member to fit in said main channel of said frame assembly once said frame assembly is installed in the doorway.

9. The entranceway barrier apparatus as set forth in claim 1, further comprising said frame gasket being selectively couplable to outer edges of said frame assembly such that a seal is formed at a juncture of said frame assembly and the doorway.

10. A entranceway barrier apparatus for blocking floodwaters from entering a structure through a doorway, said apparatus comprising:

a frame assembly for selectively mounting in a lower portion of the doorway, said frame assembly having a main channel extending therein, said frame assembly including a pair of L-shaped sections, each of said sections comprising an elongate vertical portion for positioning adjacent to a vertical part of the doorway and an elongate horizontal portion for positioning adjacent to a sill of the doorway, said horizontal portions of said sections being telescopic and mountable to each other such that a width of said frame assembly between said vertical portions is variable to fit a width of the doorway, each of said portions having a substantially C-shaped cross-section taken perpendicular to a longitudinal axis of each of said portions to form said main channel, each of said sections being positionable in the lower portion of the doorway in such a manner so that each of said horizontal portions extend inward from bottom outside corners of the doorway and each of said vertical portions extend upward along the vertical part of the doorway;

a plurality of locking members for selectively locking each of said sections of said frame assembly together in a desired position when said sections are telescopically coupled, each of said locking members being threadably mounted through an outer wall of said horizontal portion of a first of said sections to an outer wall of said horizontal portion of a second of said sections, wherein each of said locking members abuts said outer wall of said second section such that relative movement between each of said sections is restricted;

a channel gasket for positioning in said main channel of said frame assembly, said channel gasket being attached to inner walls of said frame assembly to define said main channel, said channel gasket having a substantially C-shaped cross section defining a gasket channel;

a panel member for positioning in said main channel of said frame assembly, said panel member comprising a severable material for permitting a user to cut said panel member to fit in said main channel of said frame assembly once said frame assembly is installed in the doorway, a thickness of said panel member being generally equal to a width of said gasket channel such that a seal is formed at a juncture of said panel member and said channel gasket; and a frame gasket for sealing between said frame assembly and the doorway, said frame gasket being selectively couplable to outer edges of said frame assembly such that a seal is formed at a juncture of said frame assembly and the doorway.

* * * * *